US006192541B1

(12) United States Patent
Castelli et al.

(10) Patent No.: US 6,192,541 B1
(45) Date of Patent: Feb. 27, 2001

(54) DYNAMIC RAMP INTERFACE SYSTEM

(75) Inventors: Vincent J. Castelli, Severna Park; Joseph F. Korczynski, Jr., Glen Burnie; Wayne C. Jones, Baltimore; Ely G. Fishlowitz, Silver Spring, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/538,225

(22) Filed: Mar. 30, 2000

(51) Int. Cl.[7] ..... E02B 3/20; E63C 1/00

(52) U.S. Cl. ..... 14/69.5; 14/71.1; 405/218; 405/220; 114/362; 212/308

(58) Field of Search ..... 14/69.5, 71.1; 405/218, 220; 114/362; 212/308

(56) References Cited

U.S. PATENT DOCUMENTS

| | | | | |
|---|---|---|---|---|
| 4,003,473 | | 1/1977 | Ryan . | |
| 4,162,551 | | 7/1979 | Serrano . | |
| 4,169,296 | | 10/1979 | Wipkink et al. . | |
| 4,337,545 | | 7/1982 | Rose et al. . | |
| 4,441,449 | | 4/1984 | Biaggi . | |
| 4,581,784 | * | 4/1986 | Rousseau et al. | 405/220 |
| 4,590,634 | | 5/1986 | Williams . | |
| 4,864,672 | | 9/1989 | Altieri et al. . | |
| 5,253,381 | | 10/1993 | Rawdon et al. . | |
| 5,359,746 | | 11/1994 | Kane et al. . | |
| 5,414,886 | | 5/1995 | Sust et al. . | |
| 5,823,715 | | 10/1998 | Murdoch et al. . | |

FOREIGN PATENT DOCUMENTS

| | | | | |
|---|---|---|---|---|
| 447948 | * | 3/1968 | (CH) | 14/69.5 |
| 1499741 | * | 2/1978 | (GB) | 14/69.5 |

* cited by examiner

*Primary Examiner*—David Bagnell
*Assistant Examiner*—Alexander K. Pechhold
(74) *Attorney, Agent, or Firm*—John Forrest; Jacob Shuster

(57) ABSTRACT

A dynamic ramp interface system to allow a roll-on/roll-off (RORO) ship to unload and load onto a pier, floating storage facility, or other ship during high sea states. The dynamic ramp interface system includes a motion compensation damping system attached to a first platform, a first ramp also attached to the first platform leading up to the motion compensation damping system, and second ramp that is hingedly connected to a second platform and also leading to the motion compensation damping system. The motion compensation damping system includes a top plate, a bottom plate, a series of interconnected hollow bladders, and a pivot support structure. Through this arrangement, the top plate is allowed to pivot relative to the bottom plate, with the bladder system providing a damping effect. The first ramp is slideably in communication with the top plate by means of a set of articulated fingers. The second ramp is also slideably in communication with the top plate. When used for unloading a roll-on/roll-off ship, the first platform would likely be a pier or floating storage facility, the second platform would be the roll-on/roll-off ship, and the second ramp would be the roll-on/roll-off ship's ramp. By means of the dynamic ramp interface system described herein, the roll-on/roll-off ship would be able to load and unload its cargo in both normal conditions and during high sea states.

15 Claims, 5 Drawing Sheets

DYNAMIC RAMP INTERFACE SYSTEM

STATEMENT OF GOVERNMENT INTEREST

The invention described herein may be manufactured and used by or for the Government of the United States of America for governmental purposes without payment of any royalties thereon or therefore.

BACKGROUND OF THE INVENTION

1. Field of the Invention

This invention relates to a motion compensation system to reduce the effects of relative motion between dynamically moving ramps. Specifically, the motion compensation system allows a ramp undergoing dynamic motion to safely interface with a relatively motionless structure.

2. Description of the Related Art

Both the commercial and military shipping industries have found that roll-on/roll-off (RORO) ships provide a fast and cost effective means for transporting cargo. Commercially, RORO ships are used as auto ferries due to the ease and speed with which passengers can rapidly self-load their cars onto the ship. In military applications, a RORO ship also allows the deployment of cargo and material without the use of extensive on-shore infrastructure, which gives RORO ships the capability to be used in relatively primitive conditions.

One of the downsides of the RORO ship construction is that, in high seas, they are difficult to load and unload. The key to the success of these ships requires that the ship come with a solid ramp that is sufficiently sturdy to hold the weight of automobiles and the like. Since these ramps are solid, they cannot flex or bend. While this inflexibility is not a major problem in low seas when the wave action is largely absorbed by the inertia of the ship itself, this inflexibility can be a major problem in high seas where the ship is undergoing large scale lateral, vertical, and rolling motions. In these situations, the RORO ramp will no longer cleanly interface with the pier or floating storage facility, making it unsafe to load and unload cargo.

Previous efforts to design loading and unloading systems for RORO ships did not adequately account for the high seas motions that RORO ships undergo. While these systems might allow relative motion between two platforms, they did not allow the RORO ship's ramp to move and roil at the point where it is most needed: where the ship ramp meets the pier. For example, in U.S. Pat. No. 4,441,449 to Biaggi, the invention is of a floating pier that was free to pivot about an attachment point on land. While this pier was able to move, this pier did not account for the relative rolling and sliding motions that occurs at the interface between the pier and the ship's ramp during high seas. The same is true in another floating pier concept shown in U.S. Pat. No. 5,823,715 to Murdoch et al. In these situations, the ship would be unable to load or unload safely since the RORO ship's ramp would no longer securely communicate with the dock.

In a variation on this concept, U.S. Pat. No. 5,359,746 to Kane et al. discloses a ramp junction device that accounts for the various motions between a movable platform, a movable ramp, and a fixed platform. However, this system requires that the ramp account for the various motions through a connection point at each end of the ramp. In this, and in other similar systems such as those disclosed in U.S. Pat. Nos. 4,337,545 to Rose et al., 4,169,296 to Wipkink et al., 4,003,473 to Ryan, and 4,590,634 to Williams, the essence of the solution is to provide complex connection points at the edges of a solid ramp to account for the relative motion of two maritime platforms. These complex connections often require special hardware and on-shore infrastructure that are not always available and/or practicable.

SUMMARY OF THE INVENTION

Accordingly, it is the object of this invention to allow roll-on/roll-off ships to off-load and take on cargo while in high seas.

It is a further object of this invention to provide a single motion compensation platform that accounts for the relative motion of ramps at the intersection of these ramps.

It is a further object of this invention to provide a motion compensation platform that does not require complex ramp end attachments.

It is a further object of this invention to provide an effective motion compensation system that is inexpensive to build and operate and involves little additional equipment to implement.

It is a still further object of this invention to provide a motion compensation system that requires no additional redesign of RORO ship vehicle ramps.

It is also a further object of this invention to provide a motion compensation platform that is relatively simple to transport and install in areas having little existing offloading infrastructure.

DESCRIPTION OF THE PREFERRED EMBODIMENT

Figure 1:
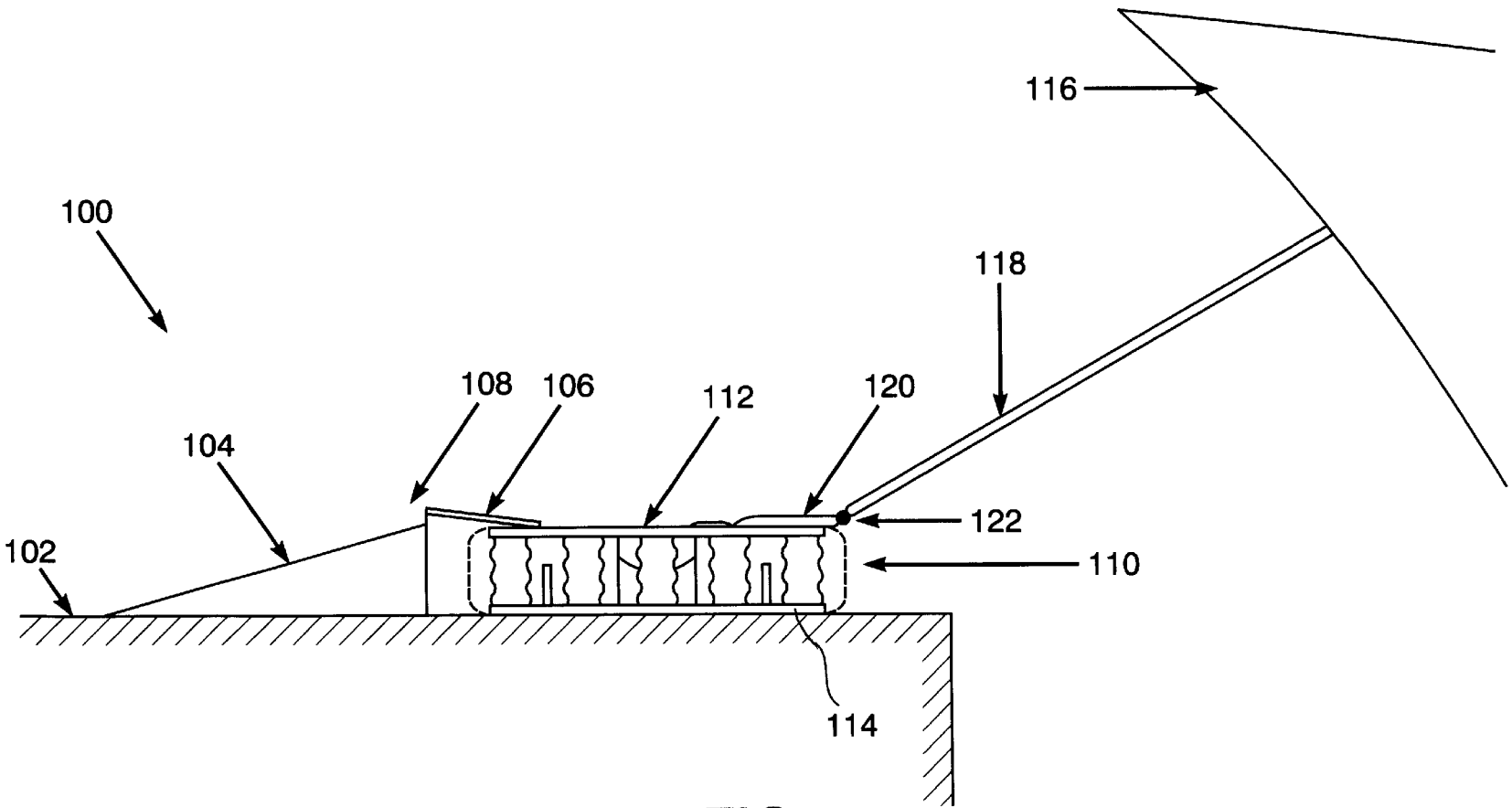
FIG. 1 is a side view of the preferred embodiment of the dynamic ramp interface system showing the interaction of the motion compensation damping system with the first platform's ramp and the second platform's ramp according to the present invention.
Figure 2:
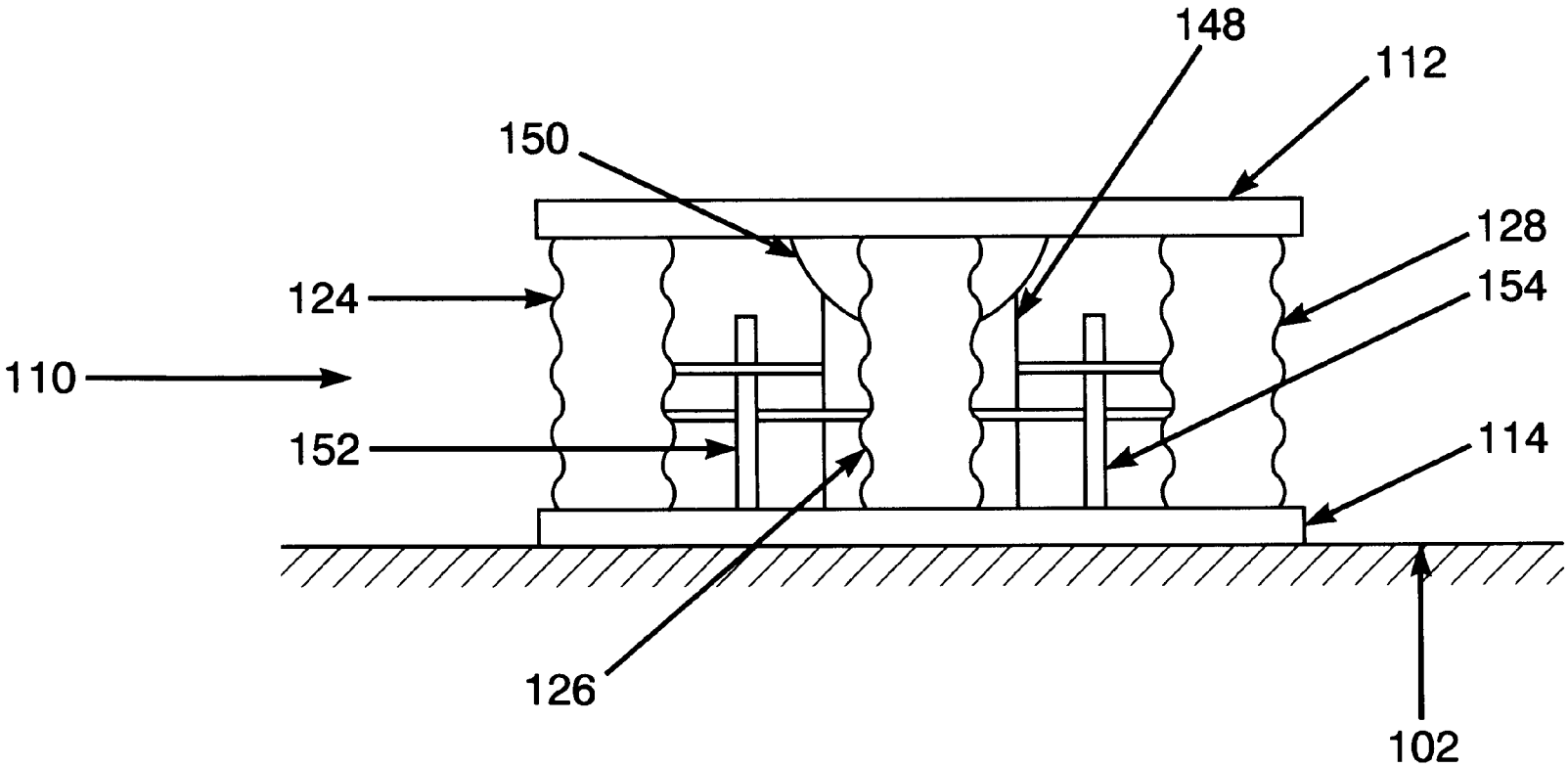
FIG. 2 is a side view of the preferred embodiment of the motion compensation damping system according to the present invention shown without the first ramp and the second ramp.
Figure 3:
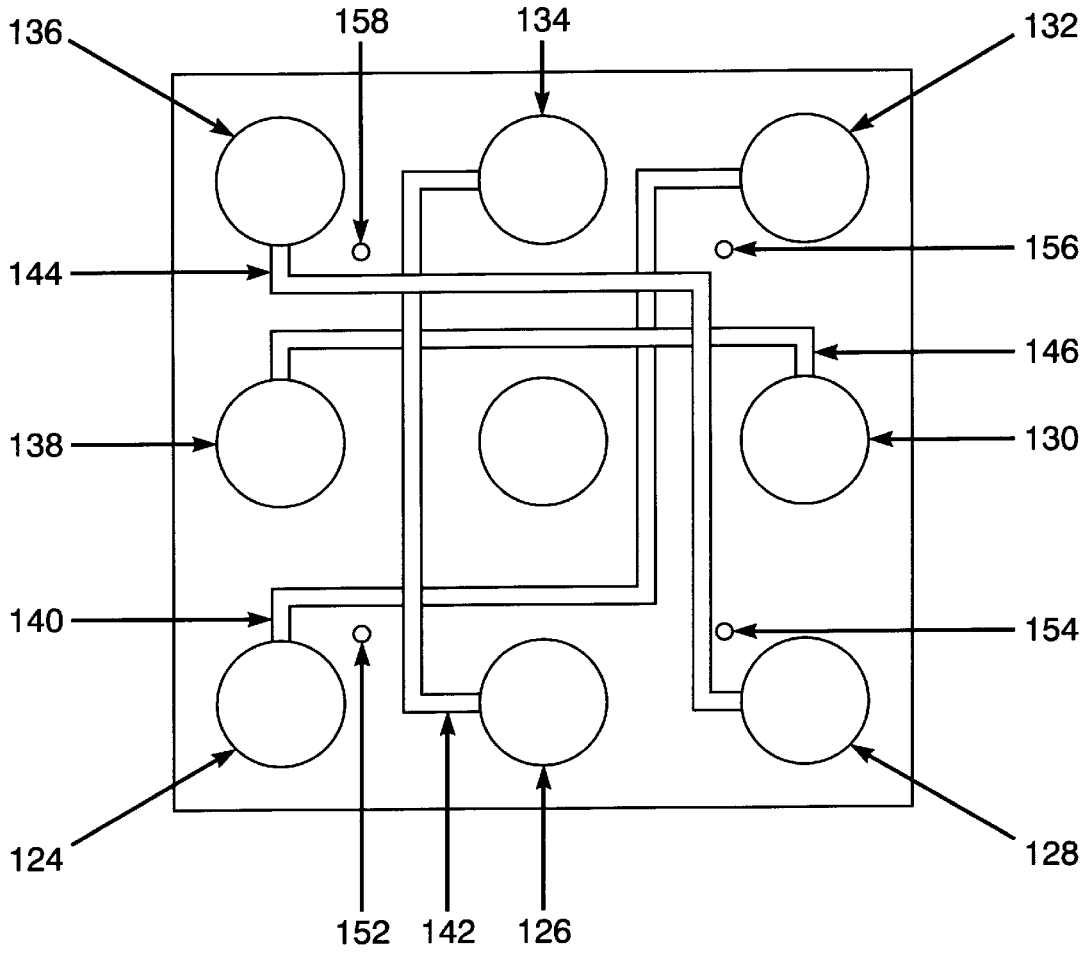
FIG. 3 is a top view of the preferred embodiment of the motion compensation damping system without the top plate showing the interconnection of the bladders according to the present invention.

As shown in FIG. 1, a preferred embodiment of the dynamic ramp interface system 100 includes a first ramp 104, a motion compensation damping system 110, and a second ramp 118. At the heart of the dynamic ramp interface system 100 is the motion compensation damping system 110. As shown in FIG. 2, in a preferred embodiment, the motion compensation damping system 110 has a bottom plate 114, which is attached to the first platform 102. As shown in FIG. 3, attached to the bottom plate 114 are bladders 124, 126, 128, 130, 132, 134, 136, and 138, which are attached around the edge of the bottom plate 114. Each bladder is made of a thick-skinned elastomeric material and contains a bladder medium such as water, air, or any other fluid or gas that is convenient. As shown in FIG. 2, bladders 124, 126, 128, 130, 132, 134, 136, and 138 are also attached to the top plate 112.

As shown in FIG. 3, each bladder is part of a bladder set that allows the bladders to balance their bladder medium levels depending on the angular position of the top plate 112. Bladder 124 is connected to bladder 132 through a hollow bladder connector 140 so as to allow the bladder medium to flow between the connected bladders. Bladder 126 is connected to bladder 134 through a hollow bladder connector 142 so as to allow the bladder medium to flow between the connected bladders. Bladder 128 is connected to bladder 136 through a hollow bladder connector 144 so as to allow the bladder medium to flow between the connected bladders. Finally, bladder 130 is connected to bladder 138 through a hollow bladder connector 146 so as to allow the bladder medium to flow between the connected bladders.

It is understood, but not shown, that more or less bladder sets could be used, depending on the loading. In addition, hollow bladder connectors might not be used where the bladders in the bladder sets are joined to one another, with simple openings at these joints providing a mechanism through which the bladder medium can flow. Lastly, each bladder set can include more than two bladders, depending on the circumstances.

Figure 4:
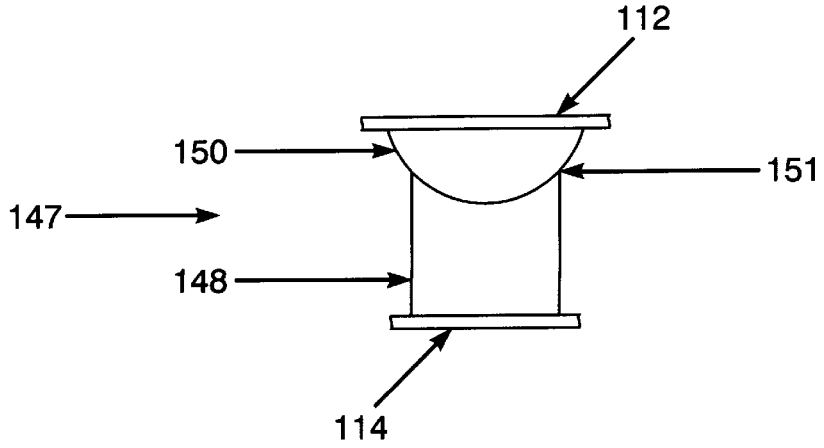
FIG. 4 is a side view of the pivot support structure according to the present invention.

In addition to the bladders, there is a pivot support structure 147 between the top plate 112 and the bottom plate 114. As shown in FIG. 4, this pivot support structure 147 is attached to both the top plate 112 and the bottom plate 114. The pivot support structure 147 provides vertical and horizontal support to the motion compensation damping system 110, while allowing the top plate 112 to pivot relative to the bottom plate 114.

In the preferred embodiment shown in FIG. 4, the pivot support structure 147 comprises a socket support 148 that is attached to the bottom plate 114, and a ball support 150, which is attached to the top plate 112. The socket support 148 interfaces with the ball support 150 to form a ball socket joint 151. Another possible pivot support structure 147 would be one utilizing a universal joint in place of the ball socket joint 151. In addition, in certain circumstances, the pivot support structure might not be utilized at all.

In order to restrain the pivot motion, there are four angular motion stops 152, 154, 156, and 158 attached to the bottom plate 114. Angular motion stops 152, 154, 156, and 158 prevent the top plate 112 from tilting past a preset angle relative to the bottom plate 114. This preset angle is dependent on factors such as the structural limitations of the bladders 124, 126, 128, 130, 132, 134, 136, or 138, and on safety concerns.

The first ramp 104 is attached to the first platform 102 and is used to communicate between a first platform 102 and the top plate 112 of the motion compensation damping system 110. The first platform 102 can be a pier, a floating platform, the deck of the ship, or any other place receiving cargo from the second platform 116. The first ramp 104 communicates with the top plate 112 through the first ramp articulated fingers 106. The first ramp articulated fingers 106 are attached to the first ramp 104 by means of a first ramp hinge 108 on one end, with the other end of the first ramp articulated fingers 106 being free to slide on the top plate 112. It is understood that this communication between the first ramp 104 and the top plate 112 can be accomplished using flexible plates, or where substantial contact is not needed at all times, conventional hinged plates may be used. In addition, it is understood that the communication mechanism can be hingedly attached to the top plate 112 instead of the first ramp 104. Lastly, where the top plate 112 is roughly level with the first platform 102, that no first ramp 104 need be used in order to communicate between the first platform 102 and the motion compensation damping system 110.

At the other end of the dynamic ramp interface system 100, second platform 116 communicates with the top plate 112 through the second ramp 118, which is hingedly attached to the second platform 116. In the preferred embedment, the second ramp 118 is a vehicle ramp, with the second platform 116 being the RORO ship itself. It is understood that the second platform 116 could be any other place from which cargo is being transferred to or from the first platform 102. The second ramp 118 communicates with the top plate 112 through a second ramp flange 120, which is hingedly connected to the second ramp 118 through a second ramp hinge 122. The second ramp flange 120 is free to slide on the top plate 112 of the motion compensation damping system 110. It is understood, but not shown, that the second ramp flange 120 could also be hingedly connected to the motion compensation damping system 110 and slideably in communication with the second ramp.

It is understood that neither ramps 104 nor 118 need be attached either to first platform 102, second platform 116, or to the top plate 112 so long as ramps 104 or 118 can provide substantial contact between the top plate 112 and the platforms 102 or 116.

FIRST ALTERNATIVE EMBODIMENT: SINGLE BLADDER RAMP

Figure 5:
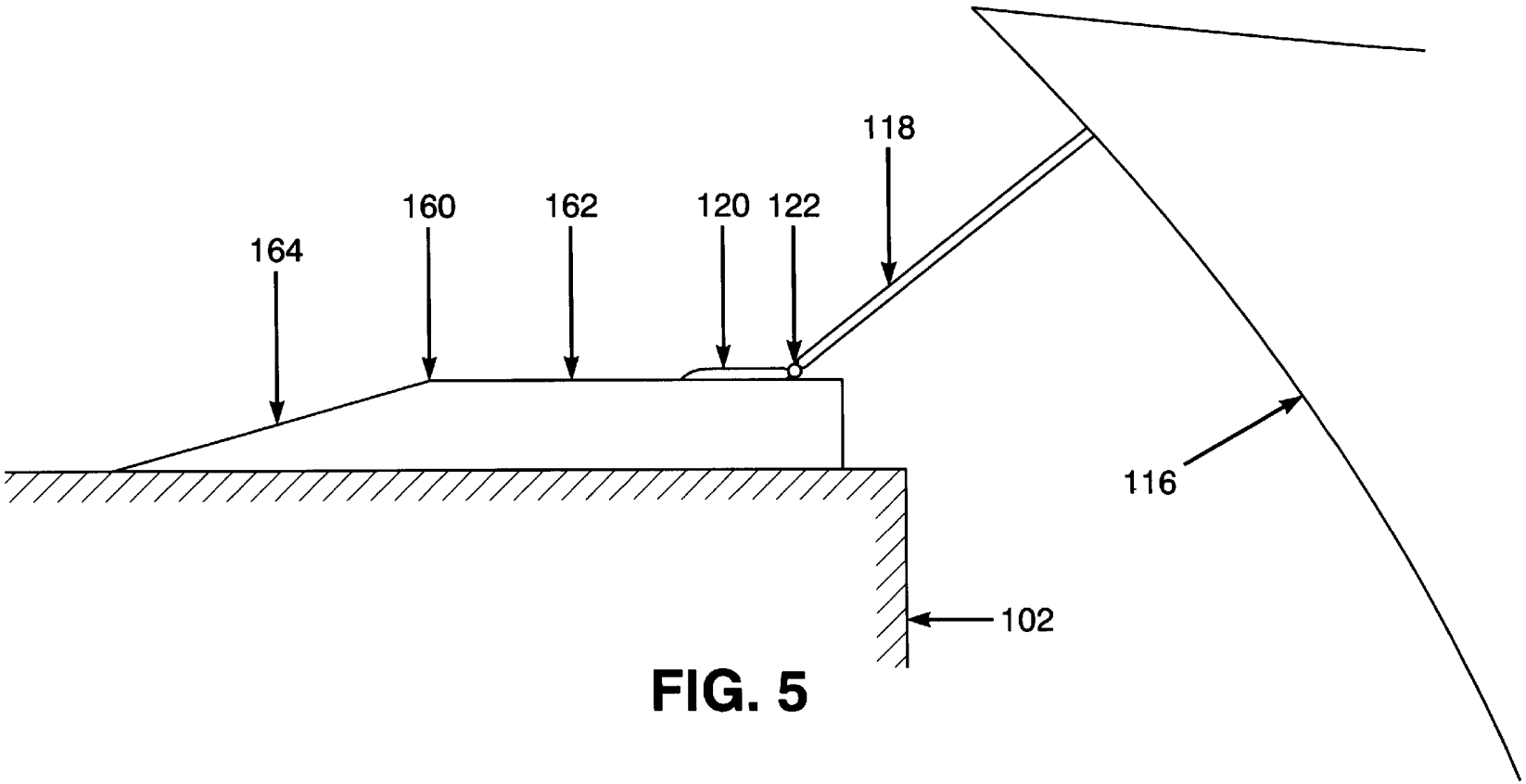
FIG. 5 is a side view of the single bladder embodiment of the motion compensation damping system according to the present invention.

An alternative embodiment of the dynamic ramp interface system 100 is shown in FIG. 5. In this embodiment, the dynamic ramp interface system 100 largely includes a first platform 102, a single bladder ramp 160, a second ramp 118, and a second platform 116. The single bladder ramp 160 is attached to the first platform 102 and has a ramp portion 164 at one end to allow loading and unloading between the top 162 of the single bladder ramp 160 and the first platform 102. In essence, the single bladder ramp 160 provides an integrated first ramp 104 and motion compensation damping system 110 shown in FIG. 1.

At the other end of the single bladder ramp 160, the second ramp flange 120 rests and is free to slide upon the top 162. The second ramp flange 120 is connected to the second ramp hinge 122, which hingedly connects the second ramp 118 to the second ramp flange 120. The second ramp 118 is attached to the second platform 116.

The single bladder ramp 160 itself is a fiber reinforced, thick-skinned elastomeric bladder filled with a bladder medium such as water, air, or any other fluid or gas. In this way, the single bladder ramp 160 can flex so as to account for the relative motion between the second platform 116 and first platform 102. In addition, since this embodiment includes an integrated ramp portion 164, there is no need for a ramp in addition to the second ramp 118.

It is understood, but not shown, that the single bladder ramp 160 might comprise a series of joined bladders where the bladder medium is distributed between joined bladders through holes in the joints between connected bladders. In addition, it is understood, but not shown in FIG. 5, that single ramp bladder 160 might also further include a pivot support system 147 such as that shown in FIG. 4 to provide additional vertical and lateral support to the single ramp bladder 160. Lastly, the second ramp 118 need not be attached to the second platform 116 or to the single ramp bladder 160 so long as the second ramp 118 remains in substantial contact with both the single ramp bladder 160 and the second platform 116.

SECOND ALTERNATIVE EMBODIMENT: PIVOT ONLY SUPPORT SYSTEM

Figure 6:
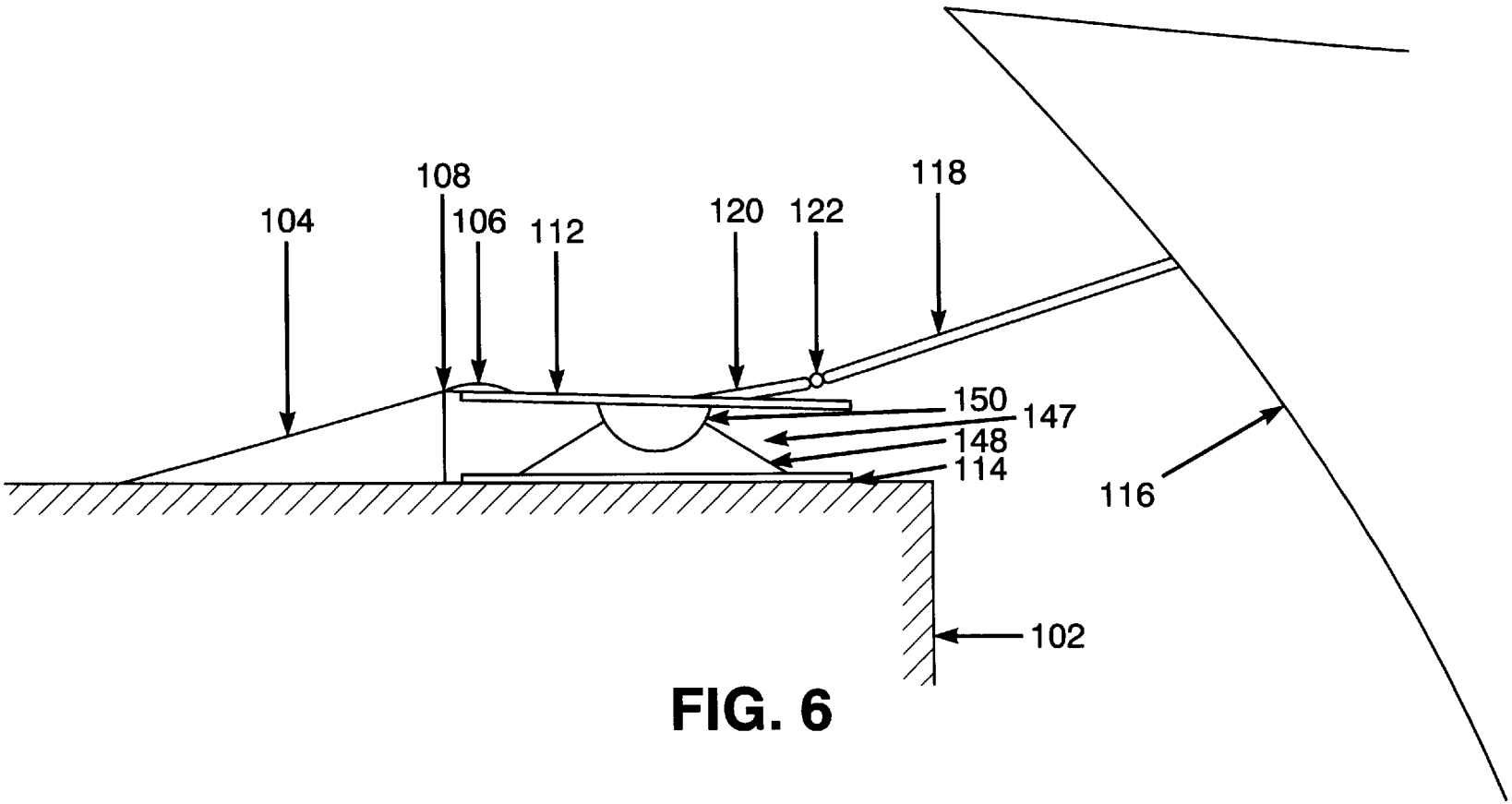
FIG. 6 is a side view of the pivot only embodiment of the motion compensation damping system according to the present invention.

Another embodiment of the dynamic ramp interface system 100 is shown in FIG. 6. According to this embodiment, the motion compensation damping system 110 is a pivot support structure 147, which is attached between a top plate 112 and a bottom plate 114. In the preferred embodiment, the pivot support structure 147 is a ball socket joint, made of a ball support 150 and a socket support 148. The top plate 112 is connected to the ball support 150, which communicates with the socket support 148 to form a ball socket joint. The socket support 148 is connected to the bottom plate 114, and the bottom plate 114 is connected to the first platform 102.

A first ramp 104 is connected to the first platform 102 to provide communication between the first platform 102 and the top plate 112. The first ramp 104 is connected to the first ramp articulated fingers 106 by a first ramp hinge 108. The first ramp articulated fingers rest on the top plate 112.

At the other end of the dynamic ramp interface system 100, the second ramp 118 is attached to the second ramp flange 120 through a second ramp hinge 122. The second ramp flange is free to slide on the top plate 112. The second ramp 118 is attached to the second platform 116 to provide communication between the second platform 116 and the top plate 112.

It is understood, but not shown, that the pivot support structure 147 may also be a universal joint or other similar joint that allows the top plate 112 to pivot relative to the bottom plate 114. In addition, the use of a first ramp 104 is not always need to allow the top plate 112 to communicate with the first platform 102. Similarly, the second ramp 118 is not always need to allow the top plate 112 to communicate with the second platform 116. Lastly, need be attached either to first platform 102, second platform 116, or to the top plate 112 so long as ramps 104 or 118 can provide substantial contact between the top plate 112, and the platforms 102 or 116.

What has been described is only one of many possible variations on the same invention and is not intended in a limiting sense. The claimed invention can be practiced using other variations not specifically described above.

What is claimed is:

1. A dynamic ramp interface system comprising: motion compensation damping means having a top and a bottom, and at least one bladder with a bladder medium therein; a first platform in communication with said top and to which the bottom is attached; and a second platform communicating with said top.

2. The dynamic ramp interface system of claim 1 wherein said at least one bladder is a plurality of bladders.

3. The dynamic ramp interface system of claim 2 wherein said plurality of bladders are organized in at least one bladder set, wherein said at least one bladder set comprises at least two of the said plurality of bladders which are interconnected whereby said bladder medium can flow between said at least two of the bladders in said at least one bladder set.

4. The dynamic ramp interface system of claim 3 further including a first ramp and a second ramp through which communication between said top and said first platform and second said platform is accomplished.

5. The dynamic ramp interface system of claim 4 wherein said motion compensation damping means further includes a pivot support structure attached between said top and said bottom.

6. The dynamic ramp interface system of claim 5, wherein said pivotal support structure comprises a ball support portion attached to said top, a socket support portion attached to said bottom and jointed to the ball support portion so as to create a ball socket joint.

7. The dynamic ramp interface system of claim 5 wherein said pivot support structure comprises a universal joint having a first and second end, wherein said first end is attached to said top and said second end is attached to said bottom.

8. The dynamic ramp interface system of claim 6 wherein said motion compensation damping means further comprises a plurality of angular motion stops attached to said bottom.

9. The dynamic ramp interface system of claim 7 wherein said motion compensation damping means further comprises a plurality of angular motion stops, wherein said angular motion stops are attached to said bottom.

10. A dynamic ramp interface system comprising: a first platform; motion compensation damping means having a ramp portion, a top in communication with the first platform through said ramp portion and a bottom attached to the first platform; and a second platform in communication with said top; said motion compensation damping means further comprising at least one bladder containing a bladder medium therein.

11. The dynamic ramp interface system of claim 10 further including a second ramp wherein said second platform communicates with said top through said second ramp.

12. The dynamic ramp interface system of claim 11 wherein said at least one bladder is a plurality of bladders.

13. The dynamic ramp interface system of claim 12 wherein said plurality of bladders are organized in at least one bladder set, wherein said at least one bladder set comprises at least two said plurality of bladders of the that are interconnected whereby said bladder medium can flow between said at least two of the said plurality of bladders in said at least one bladder set.

14. A system for dynamically interfacing two relatively movable platforms, comprising: a first ramp attached to one of the platforms; a second ramp connected to the other of the platforms; and motion compensation means operatively interconnecting said ramps for dampening motion imparted to loads during transfer between the platforms along the ramps, wherein said motion compensation means includes: a bottom plate fixed to said one of the platforms; a load transfer top plate slidably connected to both of the ramps; and fluid containing bladder means interconnecting said top and bottom plates in spaced relation to each other for effecting said motion dampening.

15. The system as defined in claim 14, wherein said one of the platforms is a loading pier and the other of the platforms is a cargo ship deck.

* * * * *